United States Patent [19]

Westlund, Jr. et al.

[11] Patent Number: 4,568,854

[45] Date of Patent: Feb. 4, 1986

[54] TUNGSTEN HALOGEN LAMP WITH HEAT-DISSIPATING BASE

[75] Inventors: Arnold E. Westlund, Jr., Winchester; Raymond T. Fleming, Lexington, both of Ky.

[73] Assignee: GTE Products Corporation, Stamford, Conn.

[21] Appl. No.: 545,990

[22] Filed: Oct. 27, 1983

[51] Int. Cl.[4] ..... H01K 1/28; H01K 1/44; H01K 1/50

[52] U.S. Cl. ..... 313/579; 313/318; 445/27; 339/144 T

[58] Field of Search ..... 313/579, 318; 445/27; 339/144 R, 144 T, 145 T

[56] References Cited

U.S. PATENT DOCUMENTS

| | | | |
|---|---|---|---|
| 3,425,027 | 1/1969 | Uberbacher et al. | 313/318 X |
| 3,431,540 | 3/1969 | Kopelman et al. | 339/112 |
| 3,500,105 | 3/1970 | Westlund, Jr. et al. | 313/318 |
| 4,084,112 | 4/1978 | Hebert et al. | 339/144 R X |
| 4,126,810 | 11/1978 | Cox | 313/318 |
| 4,152,622 | 5/1979 | Fitzgerald | 313/318 |
| 4,243,907 | 1/1981 | Kohl et al. | 313/318 |
| 4,365,396 | 12/1982 | Baba et al. | 445/27 X |

*Primary Examiner*—Palmer C. DeMeo

*Attorney, Agent, or Firm*—Lawrence R. Fraley

[57] ABSTRACT

A high temperature tungsten halogen lamp having improved lamp strength so as to reduce lamp breakage. The ceramic base for supporting the press sealed end of the lamp's envelope has a top thereof including a pair of upwardly projecting members that extend above the press sealed portion to contact the bulb portion of the lamp envelope (or capsule). These corner projecting members enable enhanced support while at the same time providing a pair of windows therebetween to enable sufficient heat dissipation (thus preventing excessively high lamp seal temperatures). In accordance with the method of the invention the envelope is cemented to the ceramic base in a two-step operation including firstly cementing the base below the projecting members to bind the base to the envelope's press sealed portion and thereafter cementing the projecting members to the envelope's bulb portion.

8 Claims, 6 Drawing Figures

TUNGSTEN HALOGEN LAMP WITH HEAT-DISSIPATING BASE

TECHNICAL FIELD

The present invention relates in general to tungsten halogen lamp bases in which the lamp capsule includes a press-sealed end. The present invention relates both to an improved lamp base construction and an improved method of manufacture of the tungsten halogen lamp. The present invention is, in particular, employed in connection with medium bipost and medium prefocus bases, both of which are known in the art.

BACKGROUND

In existing tungsten halogen lamp bases, the top of the base typically terminates at the press-sealed end of the lamp capsule below the area of the lamp where the press-sealed portion joins the major diameter of the capsule's bulb portion. Thus, in the prior art, the only portion of the capsule typically enclosed within the ceramic base is a relatively large part of the capsule's press-sealed portion. Lamps that generally depict capsule support using such an arrangement are shown in U.S. Pat. Nos. 3,431,540 (Kopelman et al.) and 4,243,907 (Kohl et al.), both assigned to the present assignee. Reference may also be made to the "IES Lighting Handbook," 4th edition, published by the Illuminating Engineering Society (New York, N.Y.), at page 8-4, wherein several types of bases, including prefocus and bipost, are illustrated. When used in conjunction with tungsten halogen lamps, such lamps typically operate at color temperatures on the order of 3200° K. By way of example, one type of lamp presently available from the assignee of this invention is classified as an EGT type lamp, which operates at 1000 watts, 120 volts, provides a nominal output (lumens) of 28,000, possesses an average rated life of about 200 hours, and employs a C-13D filament structure within its glass envelope. Examples of this and other filament structures capable of being utilized in lamps of the type defined herein are illustrated on page 8-3 (and described on pages 8-1 and 8-2 of the aforementioned "IES Lighting Handbook."

The problem with such existing designs is that breakage of the capsule at the press-seal portion may occur during shipment as well as during installation of these lamps in their respective fixtures. Breakage occasionally occurs during shipment because fixtures utilizing these lamps are typically shipped with the lamps therein. With existing tungsten halogen lamp bases, it has been found that the lamps break in the press area under typical applied force values in the range of only ten to twenty inch-pounds.

DISCLOSURE OF THE INVENTION

One object of the present invention, therefore, is to provide an improved tungsten halogen lamp wherein the base provides inproved support for the main tube of the capsule to thus reduce the possibility of breakage of the capsule which typically occurs at the capsule's press-seal.

Another object of the present invention is to provide an improved tungsten halogen lamp and associated method of manufacture wherein the lamp possesses substantially increased strength in comparison to existing lamp designs.

A further object of the invention is to provide an improved strength tungsten halogen lamp wherein the base provides sufficient lamp capsule support such that lamp breakage occurs only at values in excess of twenty inch-pounds.

Still another object of the present invention is to provide an improved tungsten halogen lamp wherein the base design is readily adapted to medium bipost and medium prefocus bases.

In accordance with one aspect of the invention, there is provided an improved high temperature tungsten halogen lamp, which is in particular characterized by an improved base construction adapted to minimize breakage of the lamp and in particular to minimize breakage of the lamp capsule at the location where the press seal joins the major diameter portion of the capsule. A lamp constructed in accordance with the present invention comprises a sealed envelope of vitreous material including a bulb portion and a press-seal portion at one end thereof. A pair of lead-in wires hermetically sealed through the press-seal in spaced-apart relationship to one another extend beyond the press-seal at one end and at the other end are connected to the lamp's filament structure (located within the envelope). The base, being ceramic, supports the press-seal end of the envelope and has at the top thereof, ear means that extend above the press-seal to the bulb of the envelope. This ear means preferably comprises a pair of oppositely disposed projection members arranged at the end corners of the press-seal and extending over the press-seal into contact with the major diameter of the bulb portion of the envelope. The projecting members preferably define therebetween a pair of heat dissipating windows (channels) that are also oppositely disposed extending along opposite sides of the press-seal. Such enhanced heat dissipation serves to prevent excessively high seal temperatures, which could damage the lamp.

Also in accordance with the invention, there is provided an improved method of assembly of a high temperature tungsten halogen lamp including a new cementing procedure to further enhance the support of the lamp's envelope so as to substantially reduce the possibility of envelope breakage. In accordance with the invention, the sealed envelope is inserted into the base with the projecting members of the lamp's base extending above the press-seal to contact the bulb of the envelope and thus provide enhanced envelope support. The base, preferably ceramic, is then cemented to the envelope, which in turn is preferably quartz. The cementing procedure is preferably performed in two separate steps, including firstly cementing the base below the projecting members to bind the base to the press-seal portion of the envelope, followed by a second cementing step to bind the projecting members to the bulb portion of the envelope.

BEST MODE FOR CARRYING OUT THE INVENTION

For a better understanding of the present invention together with other and further objects, advantages and capabilities thereof, reference is made to the following disclosure and appended claims in connection with the above described drawings.

The present invention relates to high temperature tungsten halogen lamps and particularly those that are either of the medium bipost base type or medium prefocus base type. In accordance with the invention, there is provided both a new base construction as well as a related improved method of assembly involving a novel cementing procedure which, together, provide support to the bulb portion of the lamp (capsule) envelope, resulting in a substantial reduction in the possibility of breaking the lamp (e.g., during shipping or other handling). The base material used in accordance with the present invention is ceramic, with preferred examples being porcelain and steatite.

Figure 1:
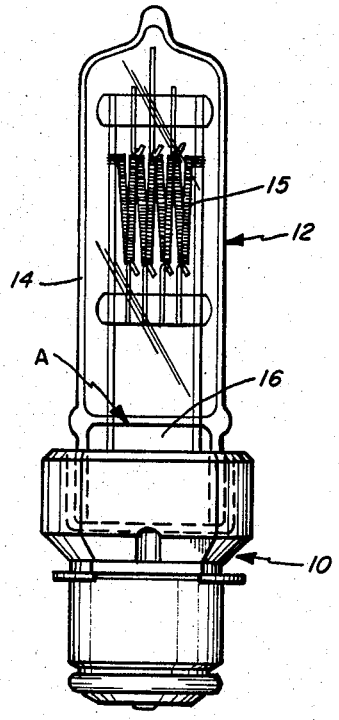
Fig. 1 PRIOR ART
FIG. 1 illustrates a prior art tungsten halogen lamp of the type with a medium prefocus base.
Figure 2:
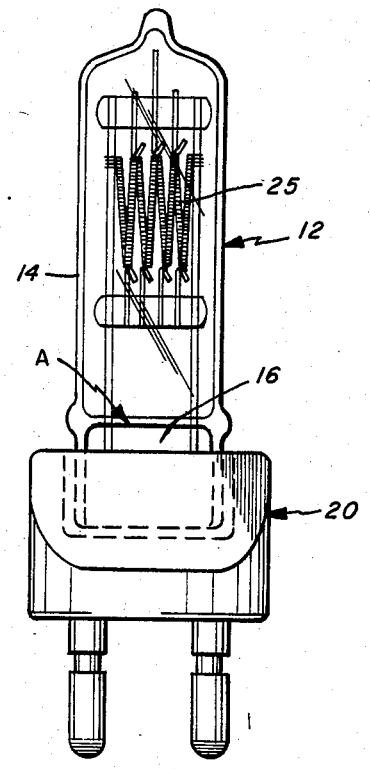
Fig. 2 PRIOR ART
FIG. 2 illustrates a prior art tungsten halogen lamp of the type with a medium bipost base.

Referring now to FIGS. 1 and 2, there are shown two different versions of known prior art tungsten halogen lamps. FIG. 1 illustrates a tungsten halogen lamp having a medium prefocus base 10 for supporting the lamp capsule 12. The lamp capsule 12 has a bulb portion 14 (typically cylindrically shaped) and a press-sealed end portion 16, said end portion oriented at the bottom of the envelope when the lamp is in its usual operating position. FIG. 1 also illustrates a plurality of filaments 15 supported in the conventional manner within the bulb portion, said plurality defining a filament structure (C-13D). The medium prefocus base 10 of the lamp of FIG. 1 may, for example, be of type typically utilized with a lamp sold under the designation EGJ.

The prior art embodiment of FIG. 2 comprises a lamp having a medium bipost base 20 for supporting the capsule 12. The capsule 12, like that of FIG. 1, comprises a bulb portion 14 and a press-sealed end portion 16, also located at the bottom of the envelope during lamp operation. As with the embodiment of FIG. 1, there are provided within capsule 12 several filaments 25 properly supported therein to define a filament structure. The medium bipost base lamp of FIG. 2 may be of the type employed with lamps sold under the designation EGT. Both the EGT lamp and the aforementioned EGJ lamp typically provide 1000 watts.

As indicated previously, it is noted in the prior art that the top of the base terminates below the area (A) where the press-sealed end 16 of the capsule essentially joins the major diameter of bulb 14. Thus, in prior art lamps such as shown in FIGS. 1 and 2, the only portion of the capsule enclosed within the ceramic base is a large part of the press-sealed portion. As indicated previously, this prior art design leads to breakage of the press-sealed portion (at area A especially), said breakage occurring especially during shipment and installation.

Figure 3:
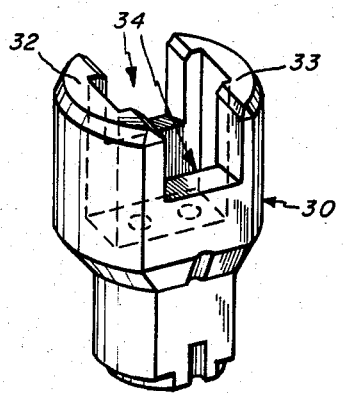
FIG. 3 is a perspective view illustrating the present invention as it applies to a medium prefocus base.
Figure 4:
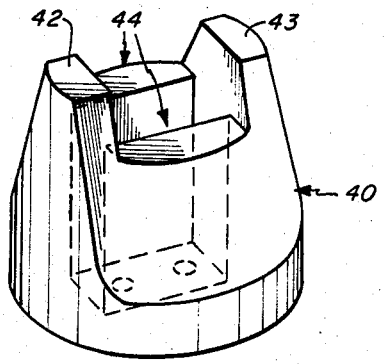
FIG. 4 is a perspective view illustrating the present invention as it applies to a medium bipost base.
Figure 5:
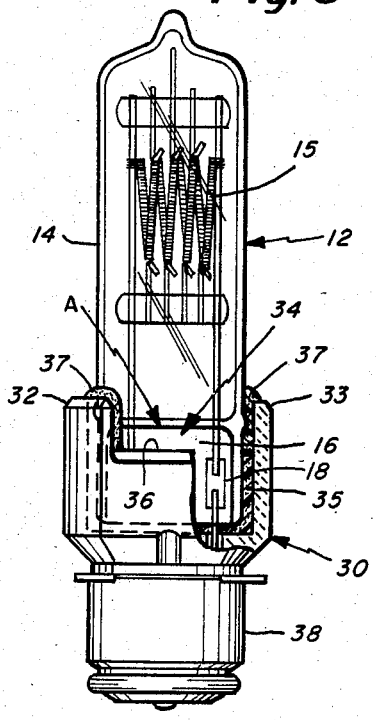
FIG. 5 shows the base of FIG. 3 assembled with a lamp capsule.
Figure 6:
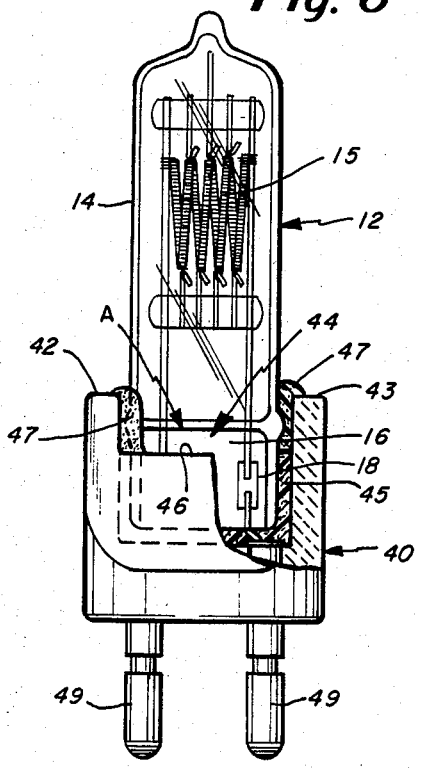
FIG. 6 shows the base of FIG. 4 assembled with a lamp capsule.

In order to overcome these problems, there is provided in accordance with the present invention, an improved base construction illustrated in perspective views in FIGS. 3 and 4 and illustrated in assembled form (with a lamp capsule) in FIGS. 5 and 6. In FIGS. 3 and 5, the base is a modified, medium prefocus base. In FIGS. 4 and 6, the base is a modified, medium bipost base. Thus, FIGS. 3 and 5 illustrate the base 30 as having upwardly extending projection members (or ears) 32 and 33. These members, which extend above what was normally the top portion of the base (see FIG. 1), define therebetween a pair of windows (channels) 34 located in the oppositely disposed orientation illustrated in FIG. 3. As shown, each window is located within one of the base's sides which interconnects the members 32 and 33. FIG. 5 shows a tungsten halogen lamp modified in accordance with the present invention and of the medium prefocus base type. In FIG. 5, as far as capsule 12 is concerned, the same reference characters have been used to identify the parts thereof as were used in the illustration of FIG. 1. Thus, capsule 12 includes a bulb (or tube) portion 14 and a press-sealed end portion 16 demarcated by the joining area A. Also shown located within end portion 16 (see also FIG. 6) is at least one foil strip 18 which serves to interconnect the illustrated conductive lead wires. Use of such strips is of course well known in the art of tungsten halogen lamps, with examples being shown and described in the aforementioned U.S. Pat. Nos. 3,431,540 and 4,243,907. Preferably, two such foils are utilized, as is also known and illustrated in these patents. The filaments 15 are disposed in a predetermined orientation within the bulb portion of capsule 12 to thus define a filament structure. The upper edge 36 of base 30 terminates at the press-sealed portion 16 but the ears 32 and 33 extend upwardly therefrom a fixed distance (i.e., approximately 0.375 inch above the joining area A).

FIG. 6 illustrates an assembled lamp employing the modified base 40 illustrated in FIG. 4. Base 40 in this version is also provided with side corner projecting members (or ears) 42 and 43. These members define therebetween a pair of heat-dissipating windows 44. As in FIG. 3, these windows 44 are each located within an opposite side of the portion of the base immediately adjacent respective sides of the press-sealed end portion of the capsule. In the assembled view of FIG. 6, like reference characters have also been used to identify the capsule 12, said capsule including a bulb portion 14 and press-sealed end portion 16. The filaments 15 are disposed in a properly supported orientation within the capsule's bulb portion. In FIG. 6, as with the embodiment of FIG. 5, base 40 has an upper edge 46 that terminates at the press-sealed end portion 16 below the bulb-end joining area A. Projecting members 42 and 43 extend upwardly from the base and extend approximately 0.375 inch over area A. In FIG. 5, the sides containing windows 34 are flat while in FIG. 6, they are preferably of curved configuration (as shown). As shown in both FIGS. 5 and 6, the upper edges 36 and 46 are located above the uppermost end of foil strip 18 such that this part of end portion 16 is located wthin (and surrounded by) the respective base.

Although the preferred embodiment of the present invention employs the aforementioned side corner extensions (or ears), in an alternate embodiment (e.g, for use with lower wattage lamps), the entire base structure may extend upwardly above the joining area A. However, for high wattage lamps of say 750 watts or greater, such an embodiment tends to increase the lamp's seal temperature to an unacceptable level. In this connection, reference is made below to tests that have been run showing how the seal temperature is affected for different versions tested.

In assembling the lamp depicted in FIGS. 5 and 6, the capsule 12 with fuse wires (not completely shown) attached thereto, is assembled to the ceramic base (which may include attached thereto a metal shell portion 38 or, in the embodiment of FIG. 6, the shown pair of metallic conductive terminal prongs or pins 4*a*). The capsule is cemented into the ceramic base and the cement allowed to cure. In accordance with the invention, a cement is used that will not displace when stress is applied to the capsule. A preferred cement is an electrotemp cement such as Sauereisen No. 8, made by The Sauereisen Cement Company (Pittsburgh, Pa.). This cement as applied is in semi-liquid form. In addition to this cement, other types may be employed, as discussed in further detail hereinafter.

The cementing operation is essentially carried out in two steps. The first step involves filling the space between the base and the press-sealed portion of the capsule to the level of edge 36 in FIG. 5 or, in the embodiment of FIG. 6, to the level of edge 46. This first quantity of cement is allowed to cure, afterwhich a second quantity of cement is inserted between the upwardly extending ceramic base members and the capsule bulb portion. With regard to the embodiment of FIG. 5, the first quantity of cement is noted by the numeral 35 and the second quantity by the numeral 37. With regard to the embodiment of FIG. 6, the first quantity is numbered 45 and the second quantity numbered 47. The aforementioned Sauereisen No. 8 cement is preferably used for both quantities of cements.

Other cements that may be employed include a cement having a potassium silicate binder and various fillers such as silica or marble flour. The consistency of such a cement is approximately putty-like and retains its general form, not slumping appreciably between application and curing. Such cement proves extremely hard and does not displace or crumble readily as stress is incurred in normal applications where these lamp types are used.

Tests have been conducted to evaluate different base designs to determine which give support to the tungsten halogen lamp so as to reduce losses during handling (e.g., during transportation and insertion within a fixture) and which also do not adversely affect the seal temperature. Basically, three different designs were tested and the results thereof shown in Table I. The letters A, B and C represent lamps including various base designs.

TABLE I

| Lamp # | Seal Temp with Reg. Base (°C. after 50 min operation) | Seal Temp Extended Ceramic Base (°C. after 50 min. operation) | Temp. Rise °C. | % Temp. Rise |
|---|---|---|---|---|
| A = BASE WITH CERAMIC EXTENDED TO BULB PORTION, FULLY CEMENT FILLED - EGT TYPE | | | | |
| 1 | 409 | 454 | 45 | 11.0 |
| 2 | 433 | 476 | 43 | 9.9 |
| Avg. | 421 | 465 | 44 | 10.4 |
| B = BASE WITH CERAMIC EXTENDED TO BULB PORTION, ENDS ONLY FILLED WITH CEMENT (EGT TYPE) | | | | |
| 1 | 409 | 435 | 26 | 6.3 |
| 2 | 433 | 480 | 47 | 20.8 |
| C = BASE WITH ONLY CORNERS OF CERAMIC EXTENDED AND CEMENTED TO BULB PORTION (EGT TYPE) | | | | |
| 1 | 407 | 418 | 11 | 2.7 |

In Table I, Lamp A involves the use of a ceramic base which extends up around the body of the capsule's bulb portion about the entire circumference thereof (in addition to totally surrounding the press-sealed end). As indicated, the entire peripheral gap between the base and the capsule is cement filled. This version has been found to raise the seal temperature to an unacceptable level, particularly on some types of lamp (notably those of the high wattage variety). Note also in Table I an average percent temperature rise of 10.4. This corresponds to a measured average temperature of 421° C. for a regular prior art base in comparison with an average temperature of 465° C. with a totally extended ceramic base. In this version, the uppermost part of the base extended about the entire bulb circumference at a height corresponding to the top of the projecting members shown in FIG. 3.

In Table I, lamp B involves a design that is substantially the same as that of lamp A but with the center area (corresponding to the flat sides of the capsule's press-sealed portion) left uncemented. In this version, there is also a rise in the seal temperature which is deemed to be excessive. This temperature rise is at an average on the order of 8.6 percent. On the other hand, with the preferred design in accordance with the present invention, the base extends upwardly above the press-sealed end portion to the bulb portion area but only at the corner ends of the press-sealed end portion. And, only these ends received cement (above the press-seal). Surprisingly, only a 2.7 percent increase in seal temperature resulted. Such a minimal increase is considered very acceptable.

The EGT lamp as used in the above tests typically operates at 1000 watts, 120 volts, has a life of about 200 hours and includes a medium bipost type base structure lamp. Two capsules fitted with chromel-alumel thermocouples were used in two of the three configurations tested. The third test (represented by lamp C) shows the use of only a single capsule. Tests were carried out in Mole-Richardson fixtures with the line voltage adjusted to 120 volts. Temperature reading were taken over 50 minutes of operation with an Omega thermocouple thermometer. Again, in the tests in Table I (lamps A and B), there is a showing of an unacceptably excessive rise in seal temperature. In the case of lamp C, however, (the base design that possessed the projection members and cement location in accordance with the present invention) only a very low rise in temperature occurred. Thus, in accordance with the present invention, there is provided a design in which the lamp's seal temperature is not significantly increased and yet wherein a substantial increase in lamp strength is provided. This proves advantageous from a manufacturing standpoint by allowing a reduction in the amount of foam cushioning typically used in packaging. In this regard, tests carried out on medium prefocus and medium bipost type lamps of the BTR and EGT variety showed that the force required to cause breakage in the jointure area of the lamp was increased by a factor of two, compared to those required to break a conventional lamp. Samples of EGT and BTR lamps using the strengthening base of the invention were subjected to a force applied to the bulb one inch from the top of the press-sealed end. These tests were carried out on a Catillon Force tester. The force was applied in a direction perpendicular to the plane of the press-sealed end, the base being clamped to a platform. In one version of the invention, a Zircon type cement was used. This was found to break in some instances when a high enough force was applied, thus allowing the press-sealed portion to break. In an alternate embodiment, marble flour cement was used and was found to give good strength, not breaking out when properly cured.

Test data relating to force (for breakage) is shown in the following Tables II and III:

TABLE II

EGT STRENGTH COMPARISON

| Lamp # | High End Base With Zircon Cement (Inch-pounds) | High End Base With Marble Flour Cement (Inch-pounds) | Control Lamp (Inch-pounds) |
|---|---|---|---|
| 1 | 26.75 | 21+ | 12 |
| 2 | 29.5 | 23.5 (cement not cured) | 11.5 |
| 3 | 21 (cement cracked) | 21+ | 11.5 |
| 4 | 23.5 (cement cracked) | 21+ | 15 |
| 5 | 24+ | 21+ | 15 |
| 6 | 17.5 (cement cracked) | 21+ | 7 |
| Avg. | 23.7+ | 21.4+ | 12 |

TABLE III

BTR HIGH END BASE

| Lamp No. | Zircon Cement (Inch-pounds) |
|---|---|
| 1 | 25+ |
| 2 | 25+ |
| 3 | 17 (cement cracked) |
| 4 | 9.5 (press too high in base) |
| 5 | 25+ |

In Table II, it is noted that for substantially all lamps tested, the breakage force was in excess of twenty inch-pounds. In Table III, the average force is also in excess of twenty inch-pounds. From Table III it can be assumed that the BTR lamp with a conventional medium prefocus base has substantially the same press strength as the conventional EGT lamp since the same capsule is used in both lamps. In this connection, note particularly the column (control lamp) in which the prior art lamp construction has a breakage in the press area with force values in the range of substantially less than twenty inch-pounds. with the average being on the order of about ten to twelve inch-pounds.

The high end base lamp in accordance with the present invention may be successfully utilized with several existing lamp types. Thus, the concepts of the invention apply to several presently available tungsten halogen lamps wherein the base is totally ceramic, examples being lamps of type EFX, BSC, BSD, or DZD. These concepts also apply to lamps in which the base is ceramic with a metallic (i.e., aluminum) electrical contacting part. Lamps of this variety include those of types BTP, EEX, BTL, BTM, BTN or BTR. These concepts also apply to lamps wherein the base is of a metallic "can" construction containing an internal cement to bind the lamp. These lamps may be of type FCV or FEP. The other lamp types to which the concepts may apply include lamps of type EGN, EGR, EGT, EGC-/EGD, EGE, EGG, EGF, DNT, EGJ, EGK or DNV, to name a few.

While there have been shown and described what are at present considered the preferred embodiments of the invention, it will be obvious to those skilled in the art that various changes and modifications may be made therein without departing from the scope of the invention as defined by the appended claims.

What is claimed is:

1. A high temperature tungsten halogen lamp comprising:

a sealed envelope of vitreous material having a bulb portion and a press-sealed portion at one end thereof;

a pair of electrically conductive lead-in wires hermetically sealed through said press-sealed portion in spaced-apart relationship to one another and extending beyond said press-sealed portion;

said lead-in wires being connected at their inner ends to a filament structure, said filament structure positioned within said bulb portion of said sealed envelope; and a ceramic base for supporting said press-sealed portion of said envelope and including a top portion having a pair of oppositely positioned upper edges thereon, said base further including spaced-apart ear means that extend from said top portion above said press-sealed portion of said envelope to said bulb portion of said envelope to engage and retain said bulb portion, thereby providing enhanced envelope support while enabling sufficient heat dissipation to thereby prevent excessively high lamp seal temperatures, said upper edges and said ear means defining terebetween a pair of heat-dissipating windows each located adjacent a respective side of said press-sealed portion of said envelope, said press-sealed portion being positioned within said ceramic base such that only a portion of each of said sides is located above said upper edges and exposed through said windows, the remainder of said press-sealed portion being positioned within and surrounded by said base.

2. The high temperature tungsten halogen lamp according to claim 1 wherein said ear means comprise a pair of oppositely-disposed projecting members located immediately adjacent the end corners of said press-sealed portion of said envelope and extending thereabove.

3. The high temperature tungsten halogen lamp according to claim 2 further including sealing cement, said cement binding sad base to said envelope.

4. The high temperature tungsten halogen lamp according to claim 3 wherein said cement includes a first quantity of cement disposed between said base and said envelope below said projecting members and said press-sealed portion of said envelope.

5. The high temperature tungsten halogen lamp according to claim 4 further including a second quantity of cement disposed substantially between said projecting members of said base and said base portion of said envelope.

6. A method of making a high temperatuare tungsten halogen lamp comprised of a sealed envelope of vitreous material having a bulb portion and a press-sealed portion at one end thereof with a pair of electrically conductive lead-in wires hermetically sealed through said press-sealed portion in spaced-apart relationship to one another and extending beyond sad press-sealed portion with sad lead-in wires connected to a filament structure positioned within said bulb portion, said method comprising:

providing a ceramic base including a top portion having a pair of oppositely positioned upper edges thereon and further including spaced-apart ear means that extend above said top portion of said base, said upper edges and said ear means defining therebetween a pair of heat-dissipating windows;

inserting said sealed envelope into said base such that said ear means extend above said press-sealed portion to contact said bulb portion of said envelope and only a portion of each of two sides of said press-sealed portion is located above a respective one of said upper edges so as to be exposed through a respective one of said heat-dissipating windows, the remainder of said press-sealed portion inserted within said base so as to be surrounded by said base; and cementing said base to both said bulb portion and said press-sealed portion of said envelope, said cemented base providing enhanced support of said envelope while enabling sufficient heat dissipation from said lamp to thereby prevent excessively high seal temperatures.

7. The method according to claim 6 wherein said cementing includes a step of firstly cementing said base below said ear means to bind said base to said press-sealed portion of said envelope prior to cementing said base to said bulb portion.

8. The method according to claim 7 further including a second cementing step to bind said ear means to said bulb portion.

* * * * *